US007158038B2

(12) United States Patent
Fujie

(10) Patent No.: US 7,158,038 B2
(45) Date of Patent: Jan. 2, 2007

(54) MONITORING SYSTEM AND METHOD

(75) Inventor: Hidekatsu Fujie, Osaka (JP)

(73) Assignee: FUNAI Electric Co., Ltd., Osaka (JP)

( * ) Notice: Subject to any disclaimer, the term of this patent is extended or adjusted under 35 U.S.C. 154(b) by 159 days.

(21) Appl. No.: 11/057,207

(22) Filed: Feb. 15, 2005

(65) Prior Publication Data

US 2005/0179553 A1 Aug. 18, 2005

(30) Foreign Application Priority Data

Feb. 16, 2004 (JP) ..... 2004-037980

(51) Int. Cl.
*G08B 23/00* (2006.01)

(52) U.S. Cl. ..... 340/573.4; 340/573.4; 340/539.13; 340/539.25; 340/573.1; 340/825.36; 340/825.49; 340/572.1; 340/5.8; 340/5.2

(58) Field of Classification Search ..... 340/573.4, 340/937, 539.13, 539.25, 573.1, 825.36, 340/825.49, 572.1, 5.8, 5.83, 5.2; 348/152, 348/61, 14.16
See application file for complete search history.

(56) References Cited

U.S. PATENT DOCUMENTS 3,928,863 A * 12/1975 Stewart et al. ..... 396/332
5,786,746 A * 7/1998 Lombardo et al. ..... 340/286.07
5,969,755 A * 10/1999 Courtney ..... 348/143
6,202,151 B1 * 3/2001 Musgrave et al. ..... 713/186
6,211,781 B1 * 4/2001 McDonald ..... 340/505
6,796,799 B1 * 9/2004 Yoshiike et al. ..... 434/236
6,856,249 B1 * 2/2005 Strubbe et al. ..... 340/573.1
7,019,644 B1 * 3/2006 Barrie ..... 340/539.13
7,106,197 B1 * 9/2006 Gaiotto et al. ..... 340/572.1

* cited by examiner

*Primary Examiner*—Daryl C Pope
(74) *Attorney, Agent, or Firm*—Bacon & Thomas, PLLC

(57) ABSTRACT

Sensing devices 1*a*, 1*b*, . . . , 1*n* for sensing a person 2 moving close to a plurality of previously selected locations and receivers 4*a*, 4*b*, . . . , 4*n* for receiving identification data transmitted from an identification tag 3 co-operate to acquire behavior data indicative of the movement pattern of a person 2, and a processing device 6 compares the behavior data to reference data relating to an authorized person previously identified by the identification data, in order to determine whether or not the result of the comparison indicates the existence of a difference. Then, when the processing device determines that the result of the comparison does not indicate the existence of a difference, it does not transmit the image data acquired via cameras 5*a*, 5*b*, . . . , 5*n* disposed in predetermined locations to a delivery system 8. In contrast, when the processing device determines that the result of the comparison indicates the existence of a difference, the processing device outputs the image data to the delivery system 8 which in turn delivers the data to a supervisor.

4 Claims, 2 Drawing Sheets

MONITORING SYSTEM AND METHOD

BACKGROUND OF THE INVENTION

1. Field of the Invention

The present invention relates to a monitoring system and method, and particularly to a monitoring system and method which allows identification of whether a person is an authorized or non-authorized person using an identification tag that stores identification data used to identify an authorized person.

2. Description of the Related Art

Conventionally, various management systems have been developed for monitoring a person who attempts to enter an area needing security and determining whether the person is an authorized or non-authorized person. For example, as disclosed in Patent document 1, a conventional technique has been proposed for capturing the image of a person entering an area needing security by using a video camera, and storing the captured image as image data in a database server. In more detail, this technique is applied to a management system that allows monitoring of persons who enter or exit an area needing security by means of an IC card. In this case, the management system includes an IC card storing identification information used to identify a bearer of the IC card and having wireless communication capability, a reading device wirelessly communicating with the IC card located near the device and reading the identification information stored in the IC card, a verification device comparing the identification information read by the reading device to previously registered information in order to determine whether or not the bearer is an authorized person, a sensor sensing a person in the vicinity of the reading device, a monitoring camera capturing the image of the person in response to the sensor sensing the person, a communication path carrying image data indicative of the image captured by the camera, and a storage device receiving via the communication path the image data indicative of the image captured by the camera when valid identification information has not been read by the reading device and storing the image data as a database associated with corresponding image-capturing time.

The reading device according to the conventional technique reads identification information stored in the IC card wirelessly when the IC card is in the vicinity of the device. Thus, after the identification information read from the bearer's IC card and previously registered information are compared, the bearer of the IC card can be notified of whether the bearer is an authorized or non-authorized person without any particular awareness of the existence of the IC card. Further, the sensor senses the person in the vicinity of the reading device. In response to the sensor sensing the person, the camera captures the image of the person. Note that in this case, the monitoring camera is operated to capture the image of the person only when the reading device fails to verify the validity of the person. This allows the management system to capture the image of a highly suspicious person and store the image as a database, and further prevents the monitoring camera from uselessly operating in order to enable efficient utilization of the capacity of a database memory.

[Patent Document 1]

Japanese Unexamined Patent Publication No. 2001-167306 (claim 1, paragraph numbers [0009], [0010], [0019])

However, drawbacks to the conventional technique are that a non-authorized person is regarded as an authorized person when the non-authorized person uses an IC card. Therefore, it can be concluded that no reliable system exists for providing appropriate security.

Accordingly, an object of the present invention is to provide a monitoring system capable of discriminating a non-authorized person from an authorized person even when the non-authorized person behaves as if he/she were an authorized person.

Another object of the invention is to apply such inventive monitoring system to a recently employed system capable of monitoring the behavior of a person.

Still another object of the invention is to provide a monitoring system capable of determining whether a person of interest is an authorized or non-authorized person using an identification tag that stores identification data used to verify an authorized person, in which the identification data stored in the identification tag is verified and in addition, a non-authorized person fraudulently holding the identification tag is discriminated.

SUMMARY OF THE INVENTION

In order to solve the above-stated problems, the invention provides the following monitoring system and method.

In accordance with the first aspect of the invention, a monitoring system includes: an identification tag capable of storing identification data used for identification of an authorized person and transmitting the identification data; sensing means, disposed in a plurality of previously selected locations, for sensing a person moving close to the locations; receiving means, disposed in the same locations as the sensing means, for receiving the identification data transmitted from the identification tag; cameras, disposed in the same locations as the sensing means, for capturing the image of the person sensed by the sensing means; processing means for storing, as reference data, a normal pattern of movement behavior of an authorized person, who has been previously identified by his/her own identification tag, usually moving between the plurality of previously selected locations, comparing behavior data relating to the person and produced based on information acquired by the receiving means and sensing means to the reference data, and if the result of the comparison does not indicate the existence of a difference therebetween, outputting no image data and if the result indicates the existence of the difference, outputting image data relating to the person; delivery means for delivering the image data output from the processing means to a monitoring device; and alerting means for sending an alert in response to the outputting of the image data from the processing means.

According to the monitoring system of the first aspect of the invention, the sensing means for sensing a person moving close to a plurality of previously selected locations and receiving means for receiving identification data transmitted from an identification tag co-operate to acquire behavior data indicative of the movement pattern of a person and the processing means compares the behavior data to the reference data relating to an authorized person previously identified by his/her own identification data, in order to determine whether or not the result of the comparison indicates the existence of a difference therebetween. Then, when the processing means determines that the result of the comparison does not indicate the existence of a difference, it does not transmit the image data acquired via the cameras to the delivery means. When the processing means determines that the result of the comparison indicates the existence of a difference, the delivery means delivers the image data transmitted from the processing means to the monitoring device. Further, the alerting means sends an alert to the locations to be monitored simultaneously when the processing means outputs the image data. The above monitoring system produces the following beneficial effects.

(1) Since the image data relating to a person is delivered when the person does not hold an identification tag and when the person holds an identification tag that is not previously registered, a non-authorized person can be reliably monitored. Further, since the image data relating to a person who holds a valid identification tag but moves in a manner different than an authorized person would have done is delivered to the monitoring device, the monitoring device is able to identify a non-authorized person who would, for example, be considered to have stolen the identification tag, allowing the monitoring system to be further reliable. Moreover, since the monitoring system automatically sends an alert to the non-authorized person, it securely excludes the non-authorized person who attempts to intrude on an area needing security.

(2) Additionally, when a person of interest is explicitly an authorized person who holds a valid identification tag and does not behave fraudulently, thus eliminating the need for monitoring, the image data having a large amount of information and being of no use at this point is not delivered to the delivery means and therefore the memory of the server can be saved and the utilization of telephone lines, etc., increases.

In accordance with the second aspect of the invention, a monitoring system includes: an identification tag capable of storing identification data used for identification of an authorized person and transmitting the identification data; sensing means, disposed in a plurality of previously selected locations, for sensing a person moving close to the locations; receiving means, disposed in the same locations as the sensing means, for receiving the identification data transmitted from the identification tag; cameras, disposed in the same locations as the sensing means, for capturing the image of the person sensed by the sensing means; processing means for storing, as reference data, a normal pattern of movement behavior of an authorized person, who has been previously identified by his/her own identification tag, usually moving between the plurality of previously selected locations, comparing behavior data relating to the person and produced based on information acquired by the receiving means and sensing means to the reference data, and if the result of the comparison does not indicate the existence of a difference therebetween, outputting no image data and if the result indicates the existence of the difference, outputting image data relating to the person; and delivery means for delivering the image data output from the processing means to a monitoring device.

According to the monitoring system of the second aspect of the invention, the sensing means for sensing a person moving close to a plurality of previously selected locations and receiving means for receiving identification data transmitted from an identification tag co-operate to acquire behavior data indicative of the movement pattern of a person and the processing means compares the behavior data to the reference data relating to an authorized person previously identified by his/her own identification data, in order to determine whether or not the result of the comparison indicates the existence of a difference therebetween. Then, when the processing means determines that the result of the comparison does not indicate the existence of a difference, it does not transmit the image data acquired via the cameras to the delivery means. When the processing means determines that the result of the comparison indicates the existence of a difference, the delivery means delivers the image data output from the processing means to the monitoring device. The above monitoring system produces the following beneficial effects.

(1) Since the image data relating to a person is delivered when the person does not hold an identification tag and when the person holds an identification tag that is not previously registered, a non-authorized person can be reliably monitored. Further, since the image data relating to a person who holds a valid identification tag but moves in a manner different than an authorized person would have done is delivered to the monitoring device, the monitoring device is able to identify a non-authorized person who would, for example, be considered to have stolen the identification tag, allowing the monitoring system to be further reliable.

(2) Additionally, when a person of interest is explicitly an authorized person who holds a valid identification tag and does not behave fraudulently, thus eliminating the need for monitoring, the image data having a large amount of information and being of no use at this point is not delivered to the delivery means and therefore the memory of the server can be saved and the utilization of telephone lines, etc., increases.

In accordance with the third aspect of the invention, a monitoring method includes: a step of acquiring behavior data relating to a person and image data derived from a captured image of the person (e.g., step S1); a step of determining whether or not the person holds an identification tag capable of storing previously registered identification data and transmitting the identification data (e.g., step S2); a step of, when identification data contained in an identification tag held by the person matches the previously registered identification data, comparing the behavior data to reference data indicative of a normal pattern of movement behavior of an authorized person who has been identified by the previously registered identification data (e.g., step S5); a step of, when the comparison between the behavior data and reference data indicates results in coincidence, causing the image data not to be transmitted to a delivery system (e.g., step S6); and a step of, when identification data matching the previously registered identification data has not been acquired or when identification data matching the previously registered identification data has been acquired and the behavior data relating to the person does not match the reference data, transmitting the image data to the delivery system to allow monitoring of the person while sending an alert (e.g., steps S3, S4).

According to the monitoring method of the third aspect of the invention, behavior data relating to a person and image data derived from a captured image of the person are acquired and whether or not the person holds an identification tag capable of storing previously registered identification data and transmitting the identification data is determined. When identification data contained in the identification tag held by the person matches the previously registered identification data, the behavior data is compared to reference data indicative of a normal pattern of movement behavior of an authorized person who has been identified by the previously registered identification data and if the comparison between the behavior data and reference data results in coincidence, the image data is not transmitted to delivery means. In contrast, if the previously registered identification data has not been acquired or if the previously registered identification data has been acquired and the behavior data relating to the person does not match the reference data, the image data is transmitted to the delivery means to allow monitoring of the person while an alert is sent. The above monitoring method produces the following beneficial effects.

(1) Since the image data relating to a person is delivered when the person does not hold an identification tag and when the person holds an identification tag that is not previously registered, a non-authorized person can be reliably monitored. Further, since the image data relating to a person who holds a valid identification tag but moves in a manner different than an authorized person would have done is delivered to the monitoring device, the monitoring device is able to identify a non-authorized person who would, for example, be considered to have stolen the identification tag, allowing the monitoring system to be further reliable.

(2) Additionally, when a person of interest is explicitly an authorized person who holds a valid identification tag and does not behave fraudulently, thus eliminating the need for monitoring, the image data having a large amount of information and being of no use at this point is not delivered to the delivery means and therefore the memory of the server can be saved and the utilization of telephone lines, etc., increases.

In accordance with the fourth aspect of the invention, a monitoring method includes: a step of acquiring behavior data relating to a person and image data derived from a captured image of the person (e.g., step S1); a step of determining whether or not the person holds an identification tag capable of storing previously registered identification data and transmitting the identification data (e.g., step S2); a step of, when identification data contained in an identification tag held by the person matches the previously registered identification data, comparing the behavior data to reference data indicative of a normal pattern of movement behavior of an authorized person who has been identified by the previously registered identification data (e.g., step S5); a step of, when the comparison between the behavior data and reference data results in coincidence, causing the image data not to be transmitted to a delivery system (e.g., step S6); and a step of, when identification data matching the previously registered identification data has not been acquired or when identification data matching the previously registered identification data has been acquired and the behavior data relating to the person does not match the reference data, transmitting the image data to the delivery system to allow monitoring of the person (e.g., steps S3, S4).

According to the monitoring method of the fourth aspect of the invention, behavior data relating to a person and image data derived from a captured image of the person are acquired and whether or not the person holds an identification tag capable of storing previously registered identification data and transmitting the identification data is determined. When identification data contained in an identification tag held by the person matches the previously registered identification data, the behavior data is compared to reference data indicative of a normal pattern of movement behavior of an authorized person who has been identified by the previously registered identification data and if the comparison between the behavior data and reference data results in coincidence, the image data is not transmitted to delivery means. In contrast, if identification data matching the previously registered identification data has not been acquired or if identification data matching the previously registered identification data has been acquired and the behavior data relating to the person does not match the reference data, the image data is transmitted to the delivery means to allow monitoring of the person. The above monitoring method produces the following beneficial effects.

(1) Since the image data relating to a person is delivered when the person does not hold an identification tag and when the person holds an identification tag that is not previously registered, a non-authorized person can be reliably monitored. Further, since the image data relating to a person who holds a valid identification tag but moves in a manner different than an authorized person would have done is delivered to the monitoring device, the monitoring device is able to identify a non-authorized person who would, for example, be considered to have stolen the identification tag, allowing the monitoring system to be further reliable.

(2) Additionally, when a person of interest is explicitly an authorized person who holds a valid identification tag and does not behave fraudulently, thus eliminating the need for monitoring, the image data having a large amount of information and being of no use at this point is not delivered to the delivery means and therefore the memory of the server can be saved and the utilization of telephone lines, etc., increases.

DETAILED DESCRIPTION OF THE PREFERRED EMBODIMENTS

Embodiments of the invention will be explained in detail below.

Figure 1:
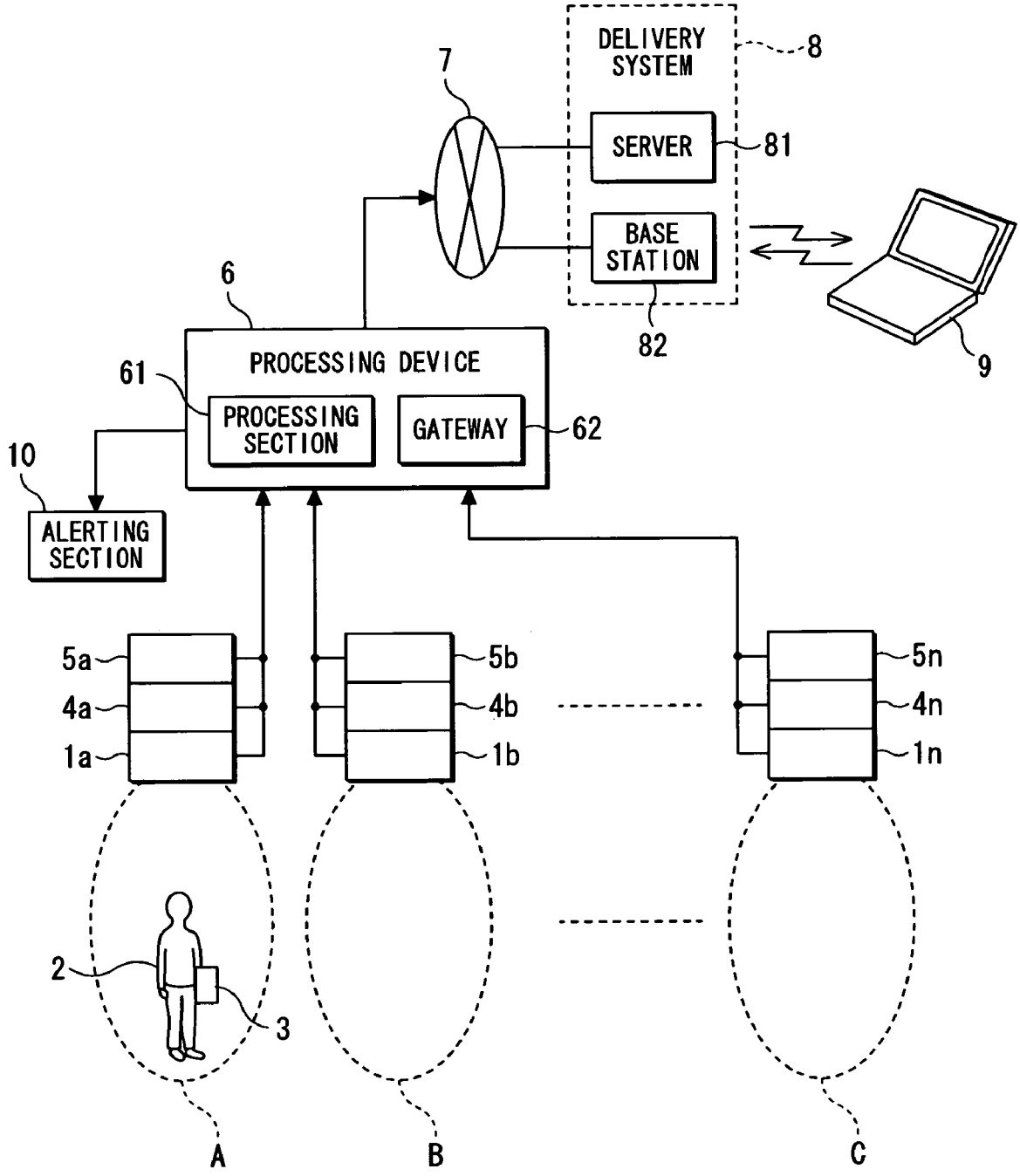
FIG. 1 is an explanatory diagram of a monitoring system according to an embodiment of the invention.
Figure 2:
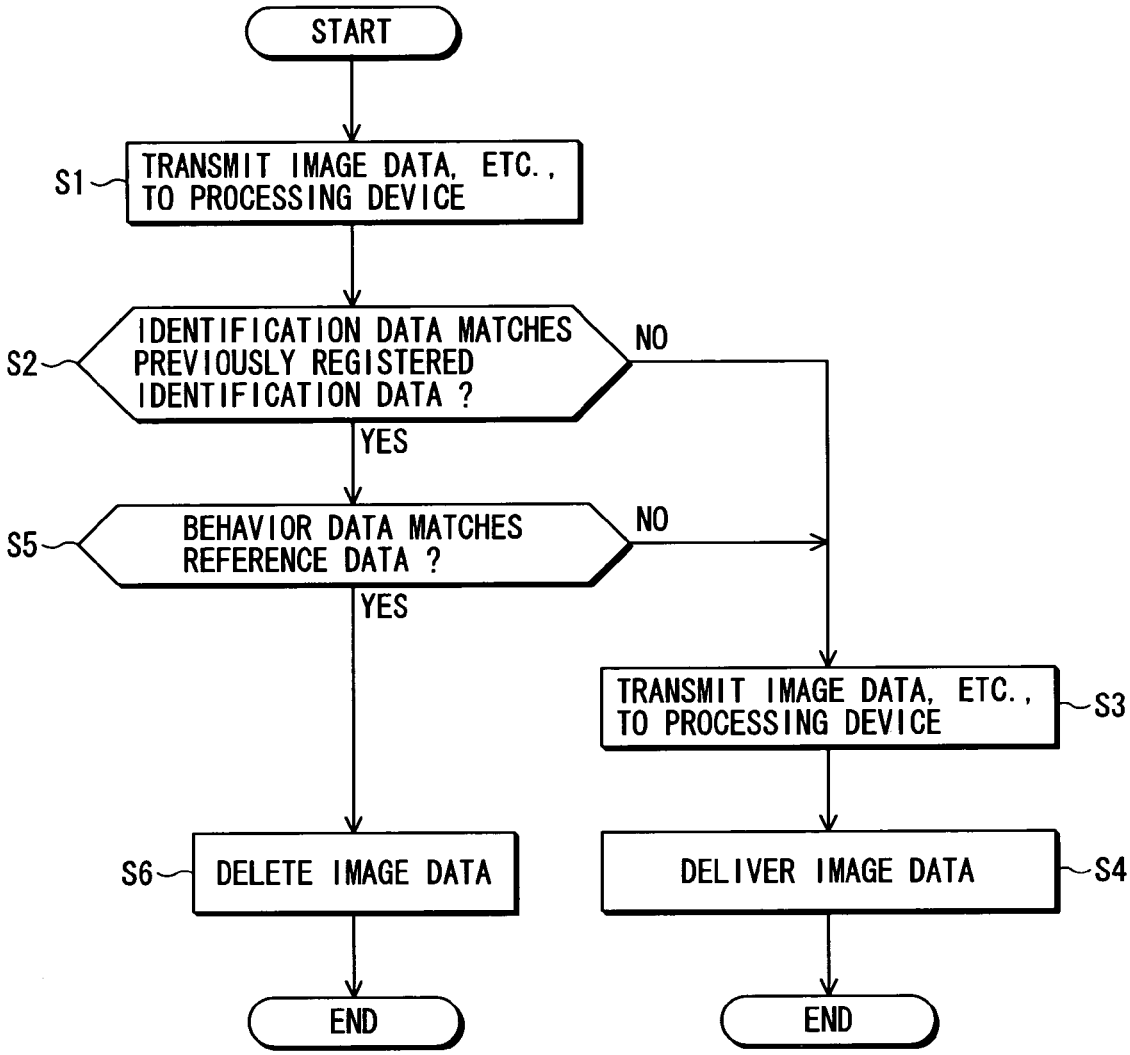
FIG. 2 is a flow chart illustrating how the monitoring system of the embodiment operates.

FIG. 1 is an explanatory diagram illustrating a monitoring system according to an embodiment of the invention and FIG. 2 is a flow chart illustrating how the monitoring system of the embodiment operates.

A monitoring system shown in FIG. 1 is applied to a residential building and includes sensing devices 1*a*, 1*b*, . . . , 1*n* disposed in a plurality of previously selected locations within the building and sense a person moving close to the locations. An authorized person 2 who is a family member entering or exiting the building holds an identification tag 3 capable of storing identification data used for personal verification and wirelessly transmitting the identification data. The sensing devices 1*a*, 1*b*, . . . , in each are provided integrally with receivers 4*a*, 4*b*, . . . , 4*n* for receiving the identification data transmitted from the identification tag 3. The sensing devices 1*a*, 1*b*, . . . , in each have a function of sensing a person moving close to respective areas A, B, . . . , N. For example, the areas A, B, . . . , N are selected so that the area A encompasses an entrance, the area B encompasses a Japanese-style room, . . . , the area N encompasses a kitchen. Further, when the identification tag is located within any one of the areas A, B, . . . , N, the corresponding one of the receivers 4*a*, 4*b*, . . . , 4*n* is able to receive identification data transmitted from the corresponding identification tag 3 (i.e., the receiver has a sufficient sensitivity to receive identification data). The sensing devices 1*a*, 1*b*, . . . , 1*n* each are provided integrally with respective cameras 5*a*, 5*b*, . . . , 5*n* for allowing the images of objects within the areas A, B, . . . , N to be captured. When the sensing devices 1*a*, 1*b*, . . . , 1*n* sense that a person has entered the areas A, B, . . . , N, the cameras 5*a*, 5*b*, . . . , 5*n* begin capturing the image of the person and when the sensing devices sense that the person has exited the areas, the cameras stop capturing the image. In this case, upon capturing the image with the camera, the monitoring system records data indicative of image-capturing date/time together with the image data.

The identification data, image data and information indicative of presence or absence of the identification data acquired by means of the sensing devices 1*a*, 1*b*, . . . , 1*n*, receivers 4*a*, 4*b*, . . . , 4*n*, and cameras 5*a*, 5*b*, . . . , 5*n* are transmitted to a processing device 6. The processing device 6 is comprised of a processing section 61 and gateway 62. The processing section 61 is for holding as reference data a behavior pattern describing how an authorized person usually moves. For example, when an authorized person who is a family member comes home, he/she first enters an entrance, moves to a Japanese-style room and then to a living room, etc, and thereafter, a behavior pattern describing how he/she has moved is stored as reference data in advance in a memory. In this case, since the rooms to which the authorized person has moved each have the sensing device installed, the sensing device senses the presence of the identification tag 3 held by the person and provides data relating to the behavior pattern of this person. Further, the processing section 61 is for acquiring as behavior data the behavior pattern of the person who holds the identification tag 3, which data has been acquired by means of the sensing devices 1*a*, 1*b*, . . . , 1*n*, and receivers 4*a*, 4*b*, . . . , 4*n*. The processing section 61 then detects a difference between an authorized person and non-authorized person by comparing the behavior data and reference data.

Output data from the processing device 6 is attached with address data and transmitted to a delivery system 8 over a network 7. The delivery system 8 is comprised of a server 81 and base station 8, and data accumulated in the server 81 is transmitted from the base station 82 over a line to a predetermined terminal device 9 corresponding to the address data. Moreover, the terminal device 9 retrieves and receives data accumulated in the server 81 via the base station 82 in order to perform monitoring. Additionally, an alerting device 10, operable to generate an alert upon detection of the image data not deleted, is connected to the output of the processing device 6. The alerting device 10 is capable of alerting the entire building when activated and/or illuminating the corresponding compartments of the building, etc.

The cameras 5*a*, 5*b*, . . . , 5*n* capture the image of a moving person and provide the image as image data to the processing section 61. When the behavior data generated from the image data is compared to the reference data and a difference therebetween is not detected, no output processing is done and uploading from the gateway 62 to the server 81 is not done. Then, the corresponding image data is deleted.

Subsequently, operation in accordance with the configuration of the above embodiment of the invention will be explained based on a flow chart in FIG. 2. In step S1, the sensing devices 1*a*, 1*b*, . . . , 1*n* sense that a person of interest has entered the areas A, B, . . . , N. In response to the sensing, the cameras 5*a*, 5*b*, . . . , 5*n* capture the image of the person and transmit the image as image data to the processing device 6. Simultaneously, when the person holds the identification tag 3, the receivers 4*a*, 4*b*, . . . , 4*n* receive identification data indicative of the presence of the identification tag 3 and transmit it to the processing device 6. In this manner, various data are acquired and transmitted to the processing device 6. In step S2, when the processing section 61 acquires both the transmitted image data and identification data, the section determines whether or not the identification data coincides with previously registered data. Based on a result of this determination, the image data acquired in case of the identification data not detected, or the image data acquired together with the identification data that is not previously registered is attached with address data and transmitted from the gateway 62 to the delivery system 8 in step S3. That is, these data are uploaded from the gateway 62 to the server 81. Simultaneously, an audible alert by the alerting device 10 occurs.

In step S4, the delivery system 8 sends an email with the image data from the base station 82 to the predetermined terminal device 9 corresponding to the address data. The terminal device 9 monitors the behavior of a non-authorized person by reproducing the image data indicative of the image of the non-authorized person. Further, even if the person of interest is an authorized person holding an identification tag and when malfunction of identification tag due to its breakage or degradation, etc., causes the person not to be identified as an authorized person, the image data is delivered to the terminal device 9 and simultaneously an alert is generated by the alerting device 10, allowing detection of accidental damages on the identification tag.

The monitoring system operates as follows when the processing section 61 determines in step S2 that the received identification data is coincident with the previously registered data. That is, in subsequent step S5, the behavior data acquired by the sensing devices 1*a*, 1*b*, . . . , 1*n* is compared to the reference data. As a result of comparison, when these data do not match, the image data is transmitted to the delivery system 8 as shown in step S3. In this case, address data is attached to the image data. In subsequent step S4, the delivery system 8 transmits the image data to the terminal device 9 corresponding to the address data. For example, when the behavior data and reference data are compared and the behavior data corresponding to a range from the entrance to the living room match the reference data but the behavior data corresponding to a range from the living room to other rooms does not match the reference data, the person of interest is identified as a non-authorized person and the image data is delivered to the terminal device 9 even if the identification data matches the previously registered identification data. Further, even when malfunction of identification tag due to its breakage or degradation, etc., causes the identification data to happen to match the registered identification data, the monitoring system identifies the person of interest as a non-authorized person by verifying that the person behaves fraudulently and delivers the image data relating to the person's behavior to the terminal device 9, thereby allowing monitoring of a non-authorized person.

When the comparison between the behavior data and reference data in step S5 results in coincidence, the person of interest is explicitly an authorized person and therefore the image data is deleted without delivering it to the delivery system 8 in step S6. Consequently, the server 81 stores only data relating to non-authorized persons needed to be monitored.

According to the above-described embodiment, the sensing devices 1*a*, 1*b*, . . . , 1*n* for sensing a person moving close to a plurality of previously selected locations and receivers 4*a*, 4*b*, . . . , 4*n* for receiving identification data transmitted from an identification tag 3 co-operate to acquire behavior data indicative of the behavior of a person and the processing device 6 compares the behavior data to the reference data relating to an authorized person, who is previously identified by the identification data stored in the processing device 6, in order to determine whether or not a difference results from the comparison. Then, when the processing device 6 determines that the difference does not result from the comparison, it does not output the image data acquired via the cameras 5*a*, 5*b*, . . . , 5*n*. The processing device 6 outputs the image data when the device does not receive the identification data, when the device receives the identification data and determines that the identification data does not match the previously registered identification data, and when the device determines that the identification data matches the previously registered identification data, but that the difference results from the comparison between the behavior data and reference data. That is, only the image data relating to a person identified as a non-authorized person is transmitted to the delivery system 8 which in turn forwards the data to the predetermined terminal device 9. Simultaneously, the alerting device 10 sends an alert to the locations to be monitored.

As described so far, according to the monitoring system of the invention, the image data corresponding to the images of a person not holding an identification tag and a person holding an identification tag that is not previously registered are delivered to the monitoring terminal device, allowing reliable monitoring of a non-authorized person. Further, since in the monitoring system, the image data corresponding to the image of a person who holds a valid identification tag but moves in a manner different than that of an authorized person is also delivered to the monitoring terminal device, a non-authorized person who would, for example, be considered to have stolen the identification tag can be identified. Moreover, since the monitoring system automatically raises an alert against the non-authorized person, it securely excludes a non-authorized person who attempts to intrude on an area needing security.

Additionally, when a person of interest is explicitly an authorized person who holds a valid identification tag and does not behave fraudulently, thus eliminating the need for verification, the image data having a large amount of information is not delivered and therefore the memory of the server can be saved and the utilization of telephone lines, etc., increases.

It should be appreciated that although in the above-stated inventive embodiment, the monitoring system has been applied to in-house security, the system has applications not only to such in-house security, but also to office security, outside facility security, etc. Moreover, examples of the terminal device 9 to which the delivery system 8 delivers various information include various devices such as a personal computer, portable telephone, etc.

It should also be noted that although in the above embodiment of the invention, the image data that the processing device 6 does not output is deleted, the image data may instead be stored in a storage device provided on the side of the processing device 6 and retrieved later and then reproduced.

It should also be noted that the above-stated invention may be configured such that the behavior data and reference data are constructed by not only the behavior pattern of a person but also other factors, such as date/time, etc., and for example, when the behavior pattern matches a previously registered behavior pattern and corresponds to a time window different from a previously registered time window, the person is identified as a non-authorized person and image data relating to the person is delivered to the terminal device. This further increases the accuracy of the monitoring system.

Additionally, although in the above embodiment of the invention, the alerting device 10 is provided to send an alert, it may not be provided.

What is claimed is:

1. A monitoring system comprising:

an identification tag capable of storing identification data used for identification of an authorized person and transmitting the identification data;

sensing means, disposed in a plurality of previously selected locations, for sensing a person moving close to the locations;

receiving means, disposed in the same locations as the sensing means, for receiving the identification data transmitted from the identification tag;

cameras, disposed in the same locations as the sensing means, for capturing the image of the person sensed by the sensing means;

processing means for storing, as reference data, a normal pattern of movement behavior of an authorized person, who has been previously identified by his/her own identification tag, usually moving between the plurality of previously selected locations, comparing behavior data relating to the person and produced based on information acquired by the receiving means and sensing means to the reference data, and if the result of the comparison does not indicate the existence of a difference therebetween, outputting no image data and if the result indicates the existence of the difference, outputting image data relating to the person;

delivery means for delivering the image data output from the processing means to a monitoring device; and alerting means for sending an alert in response to the outputting of the image data from the processing means.

2. A monitoring system comprising:

an identification tag capable of storing identification data used for identification of an authorized person and transmitting the identification data;

sensing means, disposed in a plurality of previously selected locations, for sensing a person moving close to the locations;

receiving means, disposed in the same locations as the sensing means, for receiving the identification data transmitted from the identification tag;

cameras, disposed in the same locations as the sensing means, for capturing the image of the person sensed by the sensing means;

processing means for storing, as reference data, a normal pattern of movement behavior of an authorized person, who has been previously identified by his/her own identification tag, usually moving between the plurality of previously selected locations, comparing behavior data relating to the person and produced based on information acquired by the receiving means and sensing means to the reference data, and if the result of the comparison does not indicate the existence of a difference therebetween, outputting no image data and if the result indicates the existence of the difference, outputting image data relating to the person; and delivery means for delivering the image data output from the processing means to a monitoring device.

3. A monitoring method comprising:

a step of acquiring behavior data relating to a person and image data derived from a captured image of the person;

a step of determining whether or not the person holds an identification tag capable of storing previously registered identification data and transmitting the identification data;

a step of, when identification data contained in an identification tag held by the person matches the previously registered identification data, comparing the behavior data to reference data indicative of a normal pattern of movement behavior of an authorized person who has been identified by the previously registered identification data;

a step of, when the comparison between the behavior data and reference data results in coincidence, causing the image data not to be transmitted to a delivery system; and a step of, when the previously registered identification data has not been received or when the previously registered identification data has been received and the behavior data relating to the person does not match the reference data, transmitting the image data to the delivery system while sending an alert.

4. A monitoring method comprising:

a step of acquiring behavior data relating to a person and image data derived from a captured image of the person;

a step of determining whether or not the person holds an identification tag capable of storing previously registered identification data and transmitting the identification data;

a step of, when identification data contained in an identification tag held by the person matches the previously registered identification data, comparing the behavior data to reference data indicative of a normal pattern of movement behavior of an authorized person identified by the previously registered identification data;

a step of, when the comparison between the behavior data and reference data results in coincidence, causing the image data not to be transmitted to a delivery system; and a step of, when the previously registered identification data has not been received or when the previously registered identification data has been received and the behavior data relating to the person does not match the reference data, transmitting the image data to the delivery system.

* * * * *